United States Patent [19]

Parker

[11] 4,300,549

[45] Nov. 17, 1981

[54] OPERATING ROOM FACE MASK

[75] Inventor: Duane A. Parker, North Plainfield, N.J.

[73] Assignee: Surgikos, New Brunswick, N.J.

[21] Appl. No.: 109,948

[22] Filed: Jan. 7, 1980

[51] Int. Cl.[3] ..... A62B 7/10

[52] U.S. Cl. ..... 128/206.19; 128/206.12

[58] Field of Search ..... 128/206.19, 206.12, 128/206.21

[56] References Cited

U.S. PATENT DOCUMENTS

| | | | |
|---|---|---|---|
| 3,220,409 | 11/1965 | Liloia et al. | 128/206.19 |
| 3,802,429 | 4/1974 | Bird | 128/206.19 |
| 3,985,132 | 10/1976 | Boyce et al. | 128/206.19 |

*Primary Examiner*—Henry J. Recla

[57] ABSTRACT

A face mask comprising a pleated laminate having means to secure said laminate over the nose and mouth of the wearer, said laminate comprising a first outer layer of heat sealable facing material, a second inner layer of filtration media, and a third innermost layer of heat sealable facing material, the laminate being folded to create one pleat therein that extends across the entire laminate, each end of the pleat being secured together at the edges of the laminate and the folded edge of the pleat being heat sealed along substantially its entire length securing together the three layers of laminate, and reinforcing the pleat edge such that when the pleat is open, the reinforced pleat edge maintains the laminate away from the mouth and nose of the wearer when worn.

9 Claims, 5 Drawing Figures

10
12
14
16
18
20
22
24
26
28
30
32
4
5

26
14
32
24
12
20
18
22
16
30
28

OPERATING ROOM FACE MASK

BACKGROUND OF THE INVENTION

Face masks have found use in surgical as well as industrial and hobby applications in protecting the upper respiratory system of the wearer. The wearing of a face mask may present some discomfort to the wearer, making it difficult for him to speak or breathe easily.

U.K. Pat. No. 5,104 shows a face mask designed as a dust excluding respirator. The "respirator" includes a vertical braid or cord to hold the middle portion of the respirator away from the nostrils and mouth, thus affording ample breathing space and allowing the wearer to speak with ease.

Surgical face masks originally made from woven gauze or linen having low air resistance have since been shown to have poor biological filtration efficiency (B.F.E.).

More recent surgical face masks use a mat of microdenier fibers of fiberglass or other polymeric materials sandwiched between two layers of nonwoven facing materials. This laminate has been shown to have excellent biological filtration efficiency. In these face masks, air resistance of the media may be generally correlated with the biological filtration efficiency. With greater air resistance, the face mask has a tendency to collapse about the nose and mouth. This collapse is not only irritating to the wearer, but causes excessive flexing of the mask media which potentially could cause failure of the mask. Other recently developed face masks utilize a filtration medium wherein the fibers exhibit a high affinity to microorganisms, having a high biological filtration efficiency and low air resistance, but such media are so thin or low in density that the unreinforced masks also show a tendency to collapse about the mouth and nose of the wearer.

Prior art attempts in eliminating this collapsing phenomenon describe the use of supporting framework. U.S. Pat. No. 3,985,132 describes the use of resilient stiffening wire members which bow outward and support the mask away from the nose and mouth of the wearer. 3M markets a mask which incorporates flexible wire supports which may be shaped to hold the mask out from the face. Both attempts incorporate additional material within the mask to create the supporting framework, adding to the expense of these masks, which, because they are disposable must remain low cost items.

SUMMARY OF THE INVENTION

The present invention is a face mask for covering the mouth and nose of the wearer. The mask comprises a pleated laminate having means to secure said laminate over the nose and mouth, said laminate comprising a first outer layer of fusible facing material, a second inner layer of fusible filtration media, and a third innermost layer of fusible facing material. The three layer laminate is folded, creating at least one pleat therein which extends across the entire laminate. The folded edge of the pleat is fused along substantially its entire length, and each end of the pleat is fastened together at the edges of the laminate. The fused edge of the pleat reinforcing the pleat such that, when said pleat is opened the reinforced edge maintains said laminate away from the mouth and nose of the wearer during use.

DETAILED DESCRIPTION OF THE DRAWINGS

Figures 1, 2:
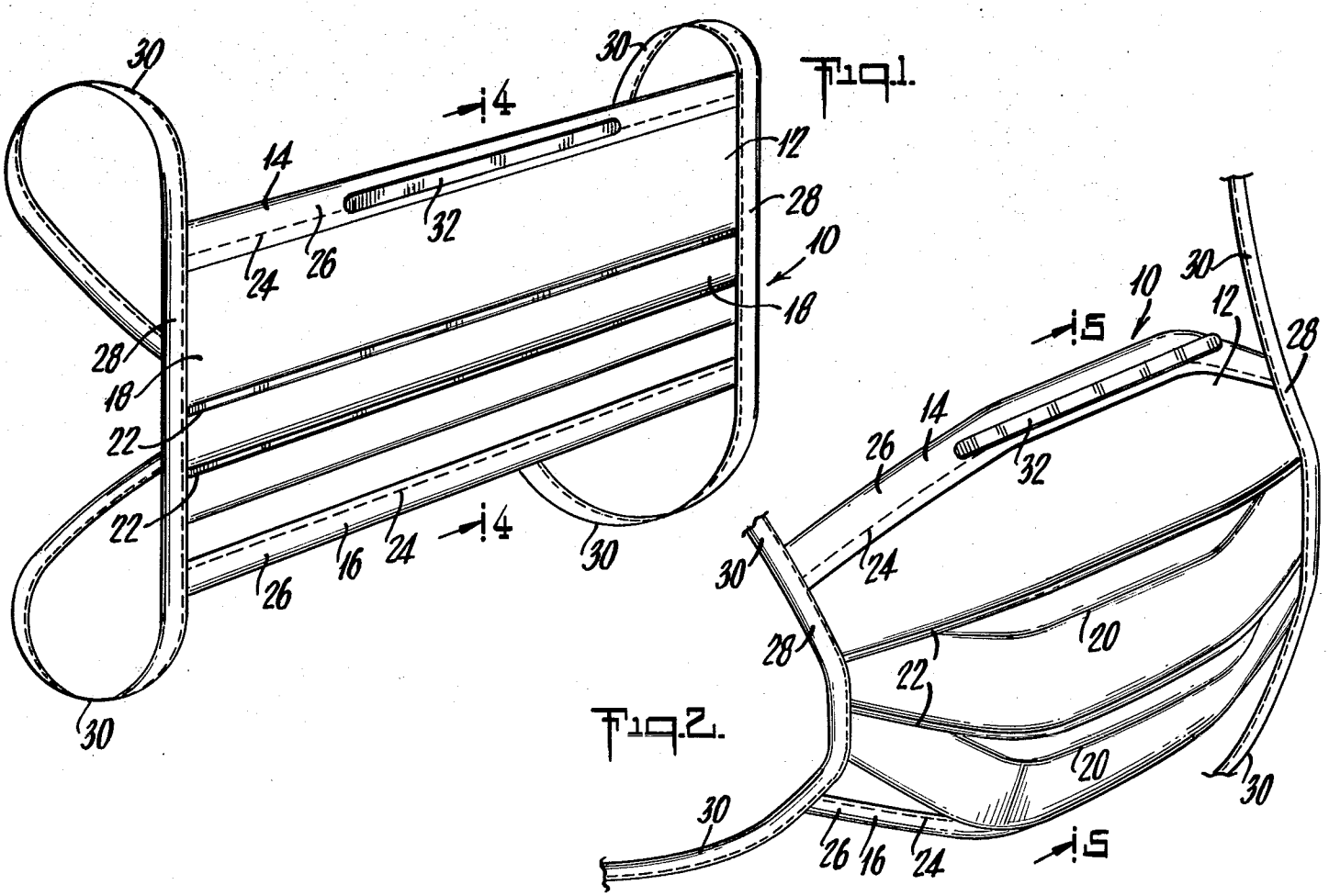
FIG. 1 is a perspective view of a preferred embodiment of the face mask of the present invention, shown in its flat configuration.
FIG. 2 is a perspective view of the face mask illustrated in FIG. 1, in its open configuration.
Figures 3, 4, 5:
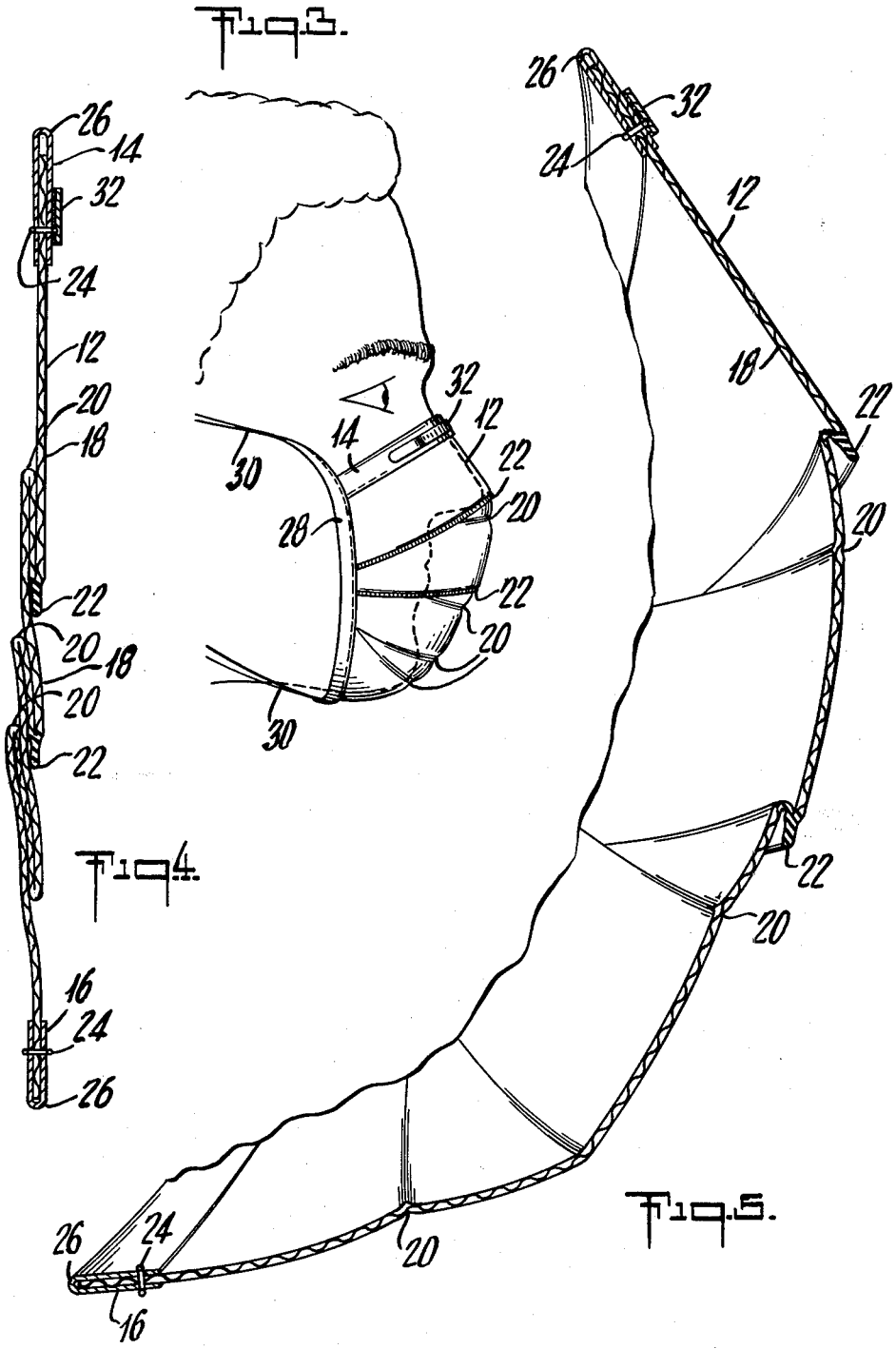
FIG. 3 is a side view of the face mask illustrated in FIG. 1, shown disposed on the face of a wearer.
FIG. 4 is a cross-section of the face mask illustrated in FIG. 1, taken along line 4—4.
FIG. 5 is an expanded cross-section of the face mask illustrated in FIG. 2, taken along line 5—5.

FIGS. 1 and 4 illustrate a preferred embodiment of the face mask of the present invention shown generally at 10. The face mask comprises a laminate 12 having a top edge 14, a bottom edge 16 and two side edges 18. The laminate is made up of three layers; a first outer layer of fusible facing material, a second inner layer of filter media and an innermost layer of fusible facing material. The laminate has a plurality of pleats 20 extending from one side of the laminate to the other side.

In the embodiment shown, the two upper pleats 22 are fused along substantially the entire length of the edge of the pleat, sealing the three layers of the laminate together into a solid, substantially airtight structure. The layers of the laminate are also bound together along the top edge, the bottom edge and the side edges. The pleat edge may be fused, for example, by heat sealing, ultra sonic welding or high frequency radio waves.

In the preferred embodiment shown, the layers of the laminate are bound together at the top and bottom edges having a row of stitches 24 attaching a binder strip 26 about the top and bottom edge of the laminate. The layers of the laminate at the side edges are bound together by rows of stitches 25 attaching a strip of binder material about each of the side edges of the laminate. In the embodiment shown, the strip of binder material attached to the side edges extends well beyond the top and bottom edge of the laminate and serves as means 30 for securing said face mask about the mouth and nose of the wearer. The rows of stitching 28 may also maintain the edges of the pleats in a folded configuration. However, other means such as fusing could be used to maintain the edges of the pleats in a folded configuration.

The face mask of the present invention may also include a deformable conforming means 32 extending across the upper edge of the laminate so as to conform the face mask to the nasal contour of the wearer.

In one embodiment of the present invention, the outer layer and the inner most layer of facing materials are nonwoven materials rendered fusible by a resin treatment.

Also, in a preferred embodiment of the present invention, the filter media comprises a fibrous mat of polymeric micro-denier fibers of, for example, polypropylene, polyester, polycarbonate, or polystyrene.

In the preferred embodiment pictured in FIG. 4, the laminate has been folded to form three lines of pleats. However, it should be noted that the laminate may be folded using an omega-fold or two back-to-back pleats.

FIGS. 2 and 5 illustrate the preferred embodiment of the face mask of FIG. 1 in its open configuration.

The fusing of the laminate at the edges of pleats 22 reinforces the pleat edges. As shown in FIG. 3, the reinforced pleat edges maintain the laminate away from the nose and mouth of the wearer during use or while worn without the addition of any stiffening material or member. Also shown in FIG. 3, the pleat 20 located about the chin of the wearer need not be reinforced.

The present invention provides a low cost, disposable face mask which resists collapse about the nose and mouth of the wearer due to the fused reinforcing of the pleat edges.

The foregoing description of the drawings are illustrative and are not to be taken as limiting. Still other variations and modifications are possible without departing from the spirit and scope of the present invention.

What is claimed is:

1. A disposable face mask comprising a flat pleated laminate capable of being opened to fit the wearer and having means to secure said laminate over the nose and mouth, said laminate having a first outer layer of fusible material, a second inner layer of filter media, and an innermost layer of fusible facing material, said laminate also having a top edge, a bottom edge, and two side edges, said laminate being folded to form a plurality of parallel pleats, each pleat extending from one side to the other, the layers of said folded laminate and the ends of the pleats therein being fastened together along the top, bottom and side edges, the folded edge of at least one of said pleats being fused along substantially its entire length to reinforce the pleat edge such that when the pleat is opened when the mask is worn, the reinforced pleat edges maintain the face mask away from the mouth and nose of the wearer during use.

2. The face mask of claim 1 wherein the filter media is a fibrous mat of polymeric micro-denier fibers.

3. A surgical face mask as in claim 1 wherein said filter media is heat fusible.

4. A face mask as in claim 1 having three parallel pleats therein.

5. The face mask of claim 4 wherein the edges of the two uppermost pleats are heat sealed.

6. A face mask as in claim 1 wherein the laminate is folded in an omega-fold.

7. The face mask of claim 1 wherein the facing materials are nonwoven.

8. The face mask of claim 1 wherein the facing materials are rendered heat sealable by resin treatment.

9. The face mask of claim 1 having a deformable conforming means horizontally extending across the upper edge of the laminate so that to conform the face mask to the nasal contour of the wearer.

* * * * *